US010891885B2

(12) United States Patent
Lee

(10) Patent No.: US 10,891,885 B2
(45) Date of Patent: Jan. 12, 2021

(54) METHOD AND TEST MACHINE PLATFORM FOR QUICKLY SEARCHING FOR COMMON VOLTAGE OF DISPLAY PANEL

(71) Applicants: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

(72) Inventor: Chia-Hang Lee, Chongqing (CN)

(73) Assignees: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 97 days.

(21) Appl. No.: 16/463,372

(22) PCT Filed: Nov. 8, 2018

(86) PCT No.: PCT/CN2018/114478
§ 371 (c)(1),
(2) Date: May 23, 2019

(87) PCT Pub. No.: WO2020/087556
PCT Pub. Date: May 7, 2020

(65) Prior Publication Data

US 2020/0320914 A1 Oct. 8, 2020

(30) Foreign Application Priority Data

Oct. 30, 2018 (CN) ..... 2018 1 1275555

(51) Int. Cl.
*G09G 3/00* (2006.01)

(52) U.S. Cl.
CPC ..... *G09G 3/006* (2013.01); *G09G 2320/0247* (2013.01); *G09G 2320/0673* (2013.01)

(58) Field of Classification Search
CPC ... G09G 2320/0247; G09G 2320/0673; G09G 3/006; G09G 3/36; G09G 3/3614; G09G 3/3655; G09G 2320/029; G09G 2360/145
See application file for complete search history.

(56) References Cited

U.S. PATENT DOCUMENTS

2003/0055591 A1* 3/2003 Whittington ..... H04N 17/04 702/108
2006/0145986 A1* 7/2006 Oh ..... G09G 3/3648 345/92

(Continued)

FOREIGN PATENT DOCUMENTS

CN 104732943 A 6/2015
CN 105096860 A 11/2015

(Continued)

OTHER PUBLICATIONS

Boher, Pierre, et al. "Flicker measurement method to adjust the common electrode voltage of LCDs." Proceedings of Asia Display 2007 (vol. 1) 1 (2007). (Year: 2007).*

(Continued)

*Primary Examiner* — Dmitriy Bolotin

(57) ABSTRACT

The present application discloses a method and a test machine platform for quickly searching for a common voltage of a display panel. The method includes: measure a flicker value of the display panel; perform a power conversion on the flicker value, and perform a unary quadratic function fitting on the converted flicker value and the corresponding common voltage; and obtain a common voltage value as a common voltage.

18 Claims, 7 Drawing Sheets

(56) References Cited

U.S. PATENT DOCUMENTS

| | | | | |
|---|---|---|---|---|
| 2007/0057975 | A1* | 3/2007 | Oh | G09G 3/3648 345/690 |
| 2007/0236484 | A1* | 10/2007 | Oh | G09G 3/3614 345/204 |
| 2015/0213769 | A1* | 7/2015 | Shin | G09G 3/3655 345/690 |
| 2016/0267855 | A1* | 9/2016 | He | G09G 3/3655 |
| 2016/0300544 | A1* | 10/2016 | Ding | G09G 3/3696 |
| 2016/0351139 | A1* | 12/2016 | Syu | G09G 3/36 |
| 2020/0320914 | A1* | 10/2020 | Lee | G09G 3/006 |

FOREIGN PATENT DOCUMENTS

| | | | |
|---|---|---|---|
| CN | 106097948 | A | 11/2016 |
| CN | 108152679 | A | 6/2018 |
| CN | 108172186 | A | 6/2018 |
| CN | 105681700 | B | 3/2019 |
| KR | 20070026021 | A | 3/2007 |
| KR | 20080105595 | A | 12/2018 |

OTHER PUBLICATIONS

International Search Report issued in corresponding international application No. PCT/CN2018/114478, dated Jul. 29, 2019(7 pages).
First Office Action from China patent office in a counterpart Chinese patent Application 201811275555.1, dated Feb. 3, 2020 (16 pages).
Second Office Action from China patent office in a counterpart Chinese patent Application 201811275555.1, dated Aug. 11, 2020 (8 pages).
Written Opinion of the International Searching Authority for No. PCT/CN2018/114478.

* cited by examiner

METHOD AND TEST MACHINE PLATFORM FOR QUICKLY SEARCHING FOR COMMON VOLTAGE OF DISPLAY PANEL

This application claims the priority to the Chinese Patent Application No. CN201811275555.1, filed to National Intellectual Property Administration, PRC on Oct. 30, 2019 and entitled "METHOD AND TEST MACHINE PLATFORM FOR QUICKLY SEARCHING FOR COMMON VOLTAGE OF DISPLAY PANEL", which is incorporated herein by reference in its entirety.

TECHNICAL FIELD

The present application relates to the field of display technology, and specifically to a method and a test machine platform for quickly searching for a common voltage of a display panel.

TECHNICAL BACKGROUND

The description herein merely provides the technical background associated with the present application and does not necessarily constitute the prior art.

With the increasing use of a display, there is an increasing demand for the display in today's society, a mobile phone, a monitor, a notebook computer, a Pad, a television, and even a plurality of smart watches all use a display panel.

For any display panel, the stability of the display effect thereof is crucial, where a flicker is a phenomenon that seriously affects display quality, because the liquid crystal display panel (LCD) needs to use a pixel voltage of non-completely symmetric positive and negative polarities to bring about a periodic high-low change in luminance, however, the magnitude of the common voltage Vcom that forms an electric field on the opposite side of the pixel voltage directly affects the display effect of a face when the common voltage Vcom is not good, causing the flicker, this not only affects people's viewing experience, but also reduces the service life of a product.

The applicant blows that a method of searching for the optimal voltage Vcom is mainly to detect each LCD panel air the voltage Vcom is changed one by one by a manual measurement method, and search for the voltage point by point until the minimum flicker value is found, then the corresponding voltage Vcom is determined to be the optimal value, a point-by-point voltage searching manner also takes a lot of time to search for the optimal voltage. Therefore, how to determine the optimal value of the common voltage Vcom faster and reduce the time for searching for the optimal voltage Vcom becomes an important issue.

SUMMARY

An object of the present application is to provide a method and a test machine platform for quickly searching for a common voltage of a display panel to solve the problem of spending more time in searching for the optimal common voltage value of the display panel.

To realize the object of the present application, the present application provides a method for quickly searching for a common voltage of a display panel, including the following steps of:

Measurement step: Measure a flicker value of the display panel at any at least three different common voltage values.

Conversion step: Perform a $2.5^{th}$ power conversion on at least three the flicker values above, and perform a unary quadratic function fitting on the converted flicker value and the corresponding common voltage;

Obtaining step: Obtain a common voltage value corresponding to the vertex of a unary quadratic function as the common voltage of the display panel.

Optionally, in the step of performing the power conversion on the at least three flicker values during the conversion step, the $2.5^{th}$ power conversion is performed.

Optionally, in the step of performing the power conversion on at least three the flicker values during the conversion step, a $2\text{-}4^{th}$ power conversion is performed.

Optionally, after the conversion step, if the fitting effect of the unary quadratic function is not good, at least three different common voltage values are reselected to measure the flicker value, and step A is performed again.

Optionally, after the conversion step, if the fitting effect of the unary quadratic function is not good, a different power value is selected to re-perform the power conversion, and the conversion step is performed again.

To realize the object of the present application, the present application still provides a public voltage test machine platform of a display panel, including:

a flicker value measurement instrument for measuring a flicker value of the display panel to be tested;

a power conversion component connected to a signal of the flicker value measurement instrument and performing a power conversion on the flicker value measured by the flicker value measurement instrument;

a fitting calculation component for performing a unary quadratic function fitting on the flicker value generated by the power conversion component and the corresponding common voltage and outputting a common voltage value corresponding to the vertex of the unary quadratic function as the common voltage of the display panel to be tested.

Optionally, the power conversion component performs a $2.5^{th}$ power conversion on the flicker value measured by the flicker value measurement instrument.

Optionally, the common voltage test machine platform of the display panel further includes a common voltage burning component, the common voltage burning component is electrically connected to a gamma control circuit of the display panel to be tested to burn the common voltage value output by the fitting calculation component into the gamma control circuit of the display panel to be tested.

Optionally, the flicker value measurement instrument is a color analyzer or a high-speed luminance meter.

As the method for quickly searching for the common voltage of the display panel described in the present application only measures the flicker value of the display panel at any of the at least three different common voltage values, performs the unary quadratic function fitting on the value of the converted flicker value and the corresponding common voltage by performing the power conversion on at least three the flicker values, and uses the characteristic of the unary quadratic function to be able to quickly fine the vertex of the unary quadratic function by means of a mathematical formula; the common voltage value corresponding to the vertex is the optimal common voltage value of the display panel, this simplifies a workflow and shortens the time to find the optimal common voltage value to the maximum extent.

As the common voltage test machine platform of the display panel according to the present application sets the flicker value measurement instrument, the power conversion component and the fitting calculation component, performs the power conversion on the measured flicker value, performs a unary quadratic function fitting on the converted flicker value and the corresponding common voltage, and uses the characteristics of the unary quadratic function to quickly find the common voltage value corresponding to the vertex of the unary quadratic function, which is the optimal common voltage value of the display panel, this simplifies a workflow and shortens the time to find the optimal common voltage value.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
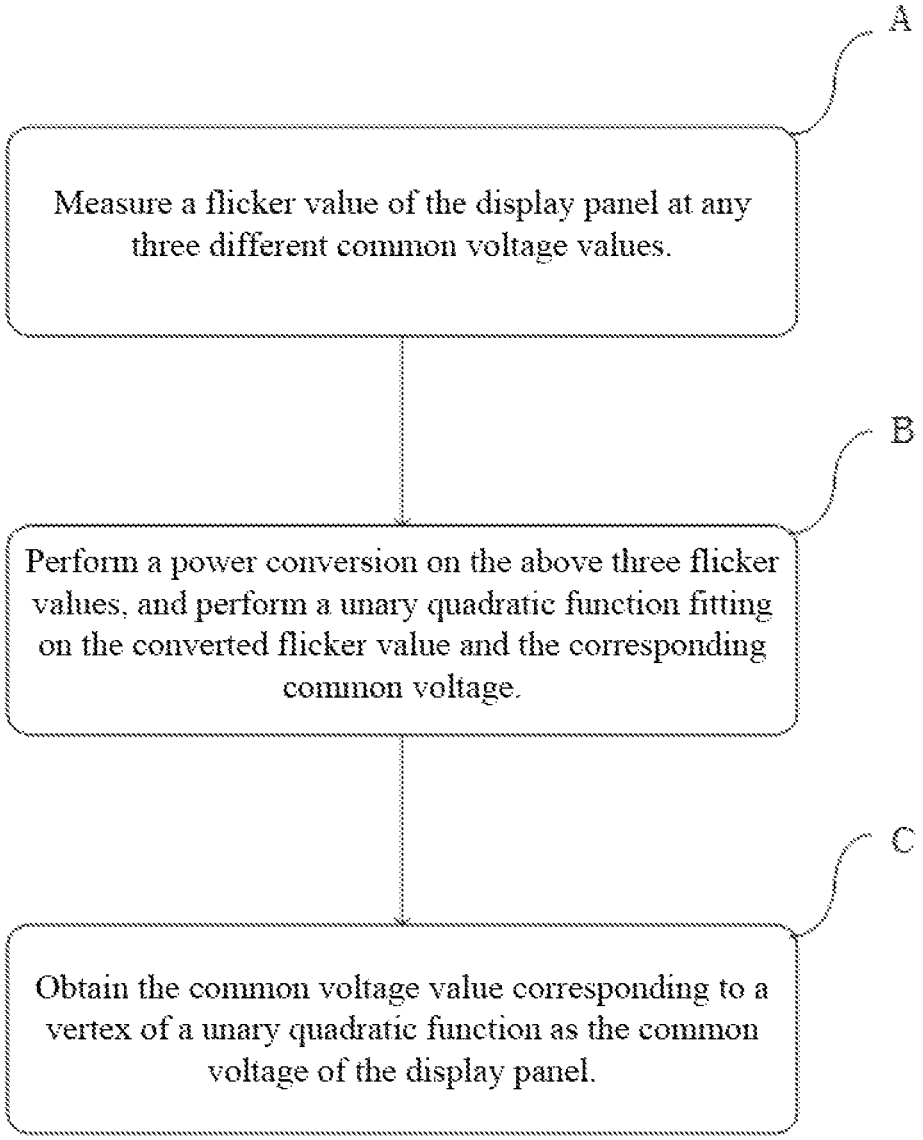
FIG. 1 is a diagram of the steps of a method for quickly searching for a common voltage of a display panel according to one of the embodiments of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

By measuring and integrating a large amount of experimental data, a multi-fitting rule of the flicker value corresponding to a common voltage Vcom is found.

As shown in FIG. 1, in an embodiment of the present application, a method for quickly searching for a common voltage of a display panel is disclosed, including the following steps:

Measurement step A: Measure flicker values of the display panel at any at least three different common voltage values.

Conversion step B: Perform power conversion on at least three the flicker values above, and perform unary quadratic function fitting on the converted flicker value and the corresponding common voltage.

Obtaining step C: Obtain a common voltage value corresponding to the vertex of the unary quadratic function as the common voltage of the display panel.

As the method for quickly searching for the common voltage of the display panel described in the present application only measures the flicker value of the display panel at any of the at least three different common voltage values, performs the unary quadratic function fitting on the value of the converted flicker value and the corresponding common voltage by performing the power conversion on at least three the flicker values, and uses the characteristic of the unary quadratic function to be able to quickly fine the vertex of the unary quadratic function by means of a mathematical formula; the common voltage value corresponding to the vertex is the optimal common voltage value of the display panel, this simplifies a workflow and shortens the time to find the optimal common voltage value to the maximum extent.

Figure 2:
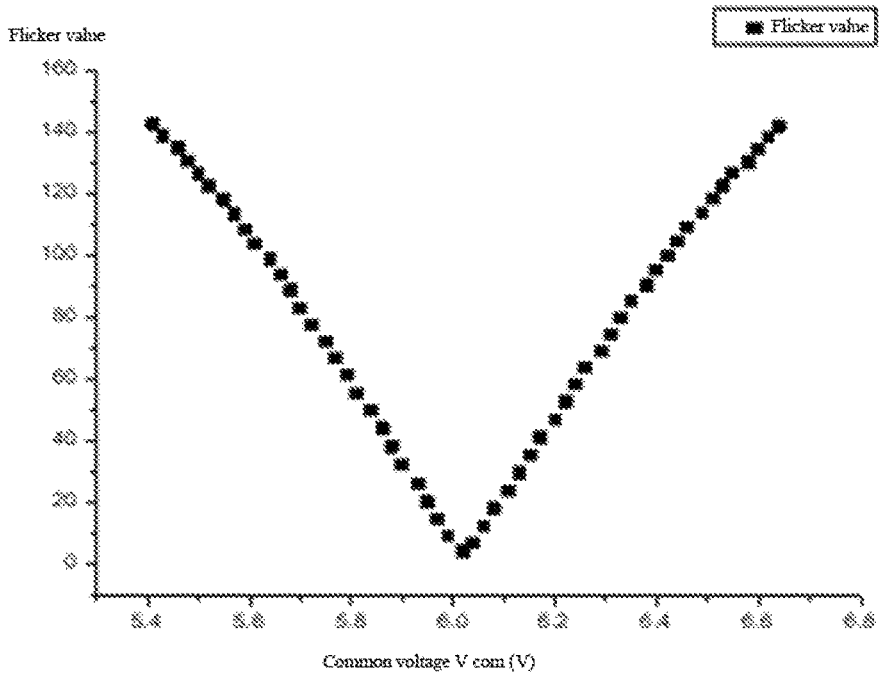
FIG. 2 is a Vcom-Flicker curve produced by drivingly measuring a discrete flicker value (Flicker value) of a corresponding display panel with different voltages Vcom in one of the embodiments of the present application.

The principle of the method for quickly searching for the common voltage of the display panel is described below by a specific example under 127 gray scales:

The applicants have found that after driving according to different voltages Vcom under the 127 gray scales, the discrete flicker values of the corresponding display panels are measured, and different panels all have Vcom-Flicker curves as shown in FIG. 2.

Figure 3:
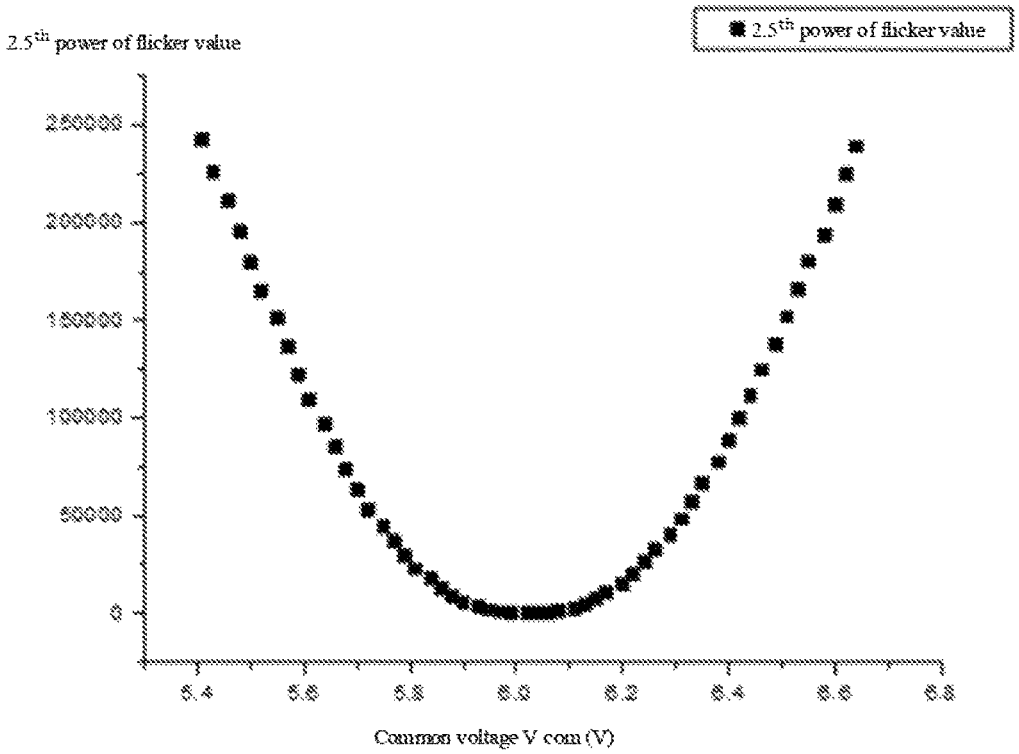
FIG. 3 is each numerical value point obtained by performing a $2.5^{th}$ power conversion of on a discrete flicker value in FIG. 2.
Figure 4:
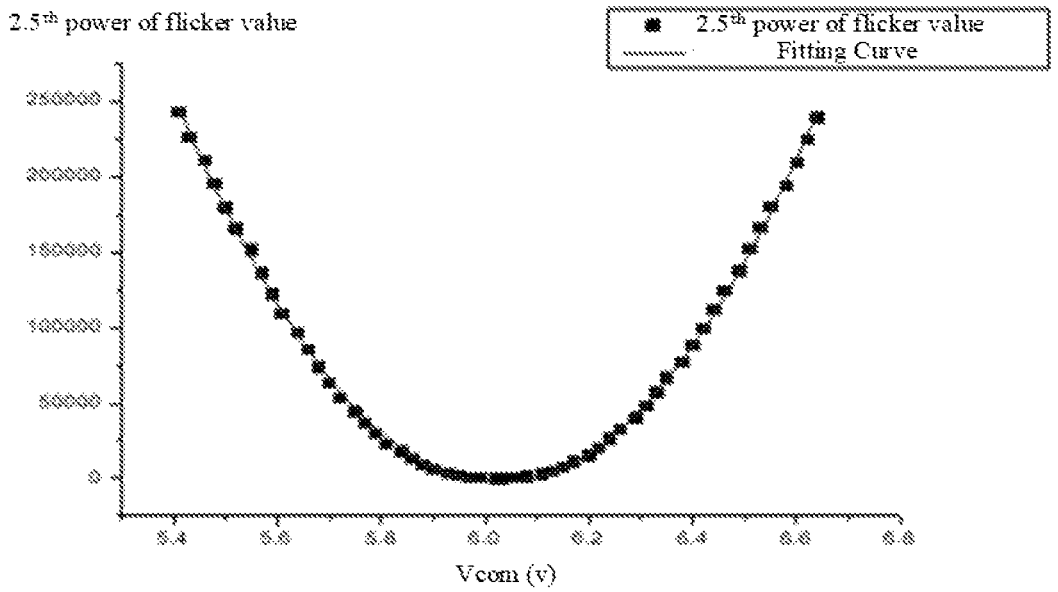
FIG. 4 is a unitary quadratic curve obtained by performing mathematical function fitting to each numerical point in FIG. 3.

After the discrete Flicker value in the above Vcom-Flicker curve is performed with the $2.5^{th}$ power conversion, the numerical points shown in FIG. 3 can be obtained; after the analysis of the mathematical function fitting, the flicker value obtained after the $2.5^{th}$ power conversion has a unary quadratic curve relationship with the corresponding common voltage value Vcom, that is, the curve as shown in FIG. 4. The unary quadratic function fitting is performed on the converted flicker value and the corresponding common voltage, by using the characteristics of the unary quadratic function, the vertex of the unary quadratic function can be quickly found through the mathematical formula; the common voltage value corresponding to the vertex is the optimal common voltage value of the display panel, by the measurement with less common voltage, and even by the measurement of the flicker value at at least three different common voltages, the optimal common voltage Vcom can be quickly determined, which simplifies a workflow and shortens the time to find the optimal common voltage value to the maximum extent.

Of course, the power value of the power conversion may be other setting other than 2.5, such as 2, 3, 4, and the like. After many experiments, the applicant found that after $2\text{-}4^{th}$ power conversion was performed on at least three the flicker values, the image of the unary quadratic function that is fitted and generated had higher fitting accuracy and was more favorable for vertex calculation than other images.

Figure 5:
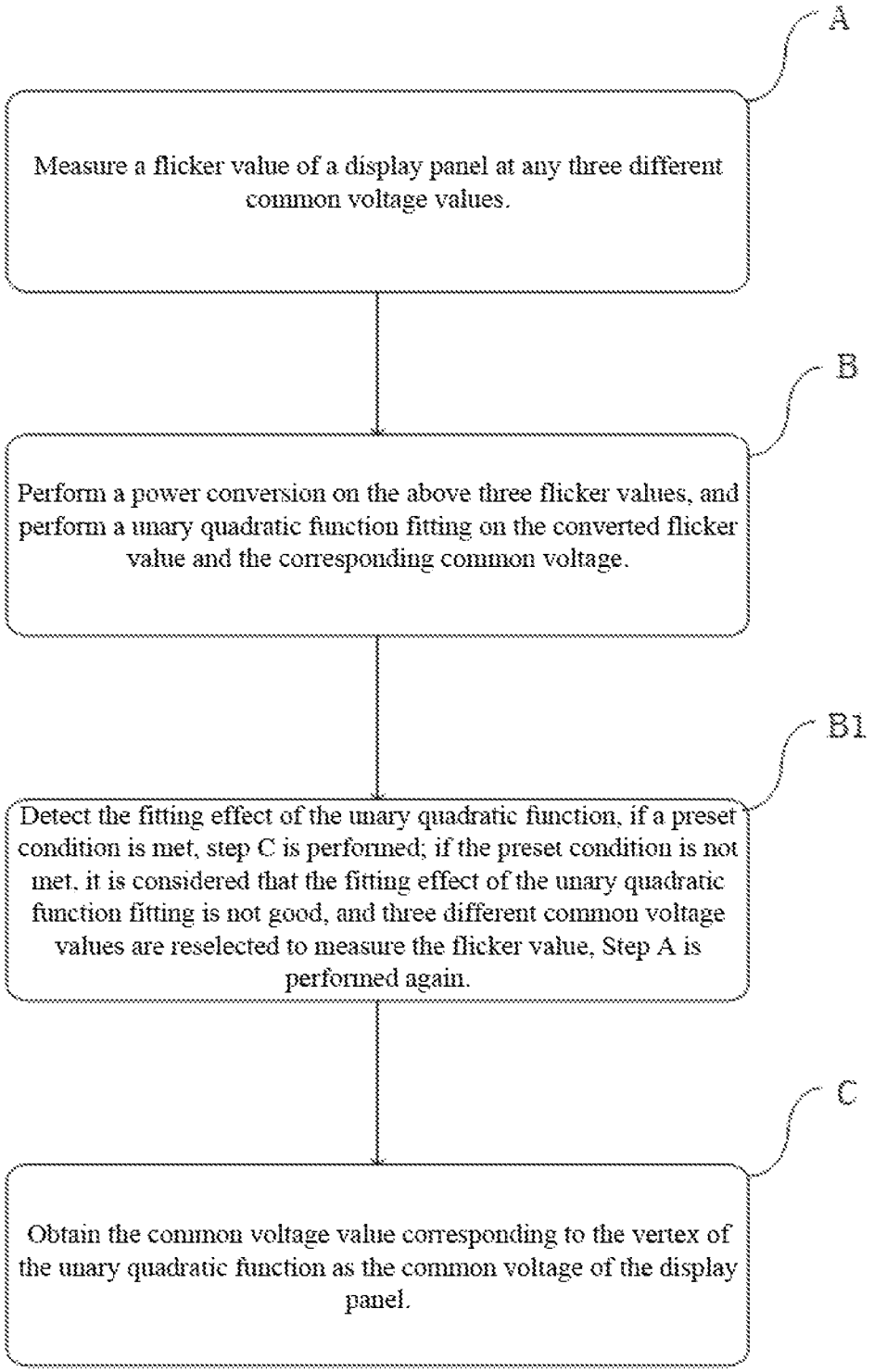
FIG. 5 is a diagram of the steps of a method for quickly searching for a common voltage of a display panel according to one of the embodiments of the present application.

As shown in FIG. 5, in another embodiment of the present application, a method for quickly searching for a common voltage of a display panel is disclosed, including the following steps:

Measurement step A: Measure a flicker value of the display panel at any at least three different common voltage values.

Conversion step B: Perform power conversion on at least three the flicker values, and perform a unary quadratic function fitting on the converted flicker value and the corresponding common voltage.

Conversion step B1: Detect the fitting effect of the unary quadratic function, if a preset condition is met, obtaining step C is performed; if the preset condition is not met, it is considered that the fitting effect of the unary quadratic function is not good, then at least three different common voltage values are reselected to measured the flicker value and perform measurement step A again;

Obtaining step C: Obtain the common voltage value corresponding to the vertex of the unary quadratic function as the common voltage of the display panel.

Such a design facilitates the implementation of automated detection. If the common voltage value selected in the previous time in measurement step A is not good and causes the fitting effect of the unary quadratic function in conversion step B not to be good, the measurement of the flicker value is performed on at least three the different common voltage values again until the unary quadratic function fitting condition is met.

Figure 6:
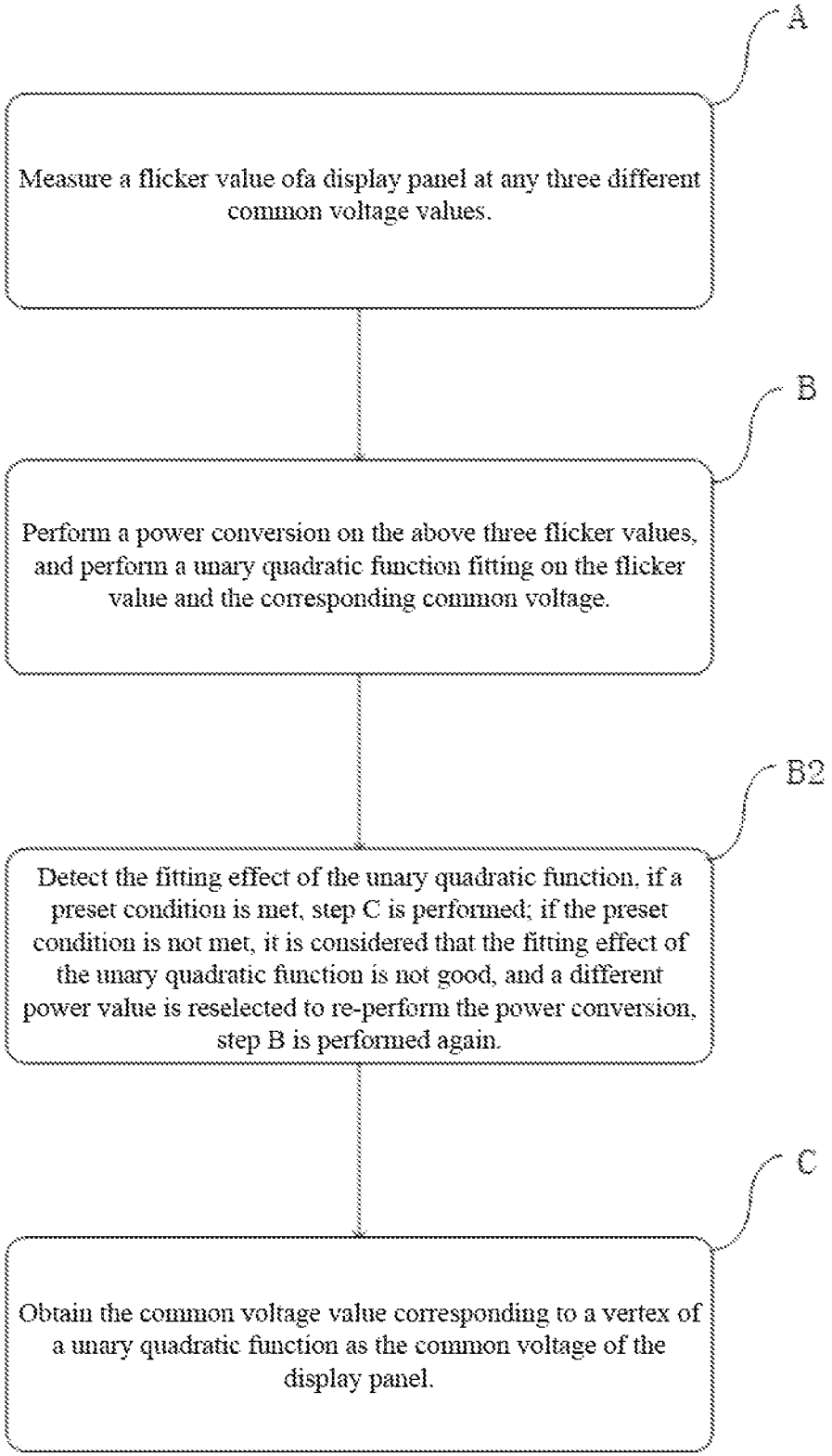
FIG. 6 is a diagram of the steps of a method for quickly searching for a common voltage of a display panel according to one of the embodiments of the present application.

As shown in FIG. 6, in another embodiment of the present application, a method for quickly searching for a common voltage of a display panel is disclosed, including the following steps:

Measurement step A: Measure a flicker value of the display panel at any at least three different common voltage values.

Conversion step B: Perform power conversion on at least three the flicker values above, and perform a unary quadratic function fitting on the converted flicker value and the corresponding common voltage.

Conversion step B2: Detect the fitting effect of the unary quadratic function, if a preset condition is met, obtaining step C is performed; if the preset condition is not met, it is considered that the fitting effect of the unary quadratic function is not good, a different power value is selected to re-perform the power conversion, and perform the conversion step B again;

Obtaining step C: Obtain the common voltage value corresponding to the vertex of the unary quadratic function as the common voltage of the display panel.

Such a design facilitates the implementation of automatic detection, if the selection of the power value in conversion step B is not good and causes the fitting effect of the unary quadratic function in conversion step B not to be good, a different power value is reselected to re-perform the power conversion until the unary quadratic function fitting condition is met.

In an embodiment, in the step of the conversion step B of performing the power conversion on at least three flicker values, a $2.5^{th}$ power conversion is performed.

In the present solution, after performing the $2.5^{th}$ power conversion on at least three flicker values, the image of the unary quadratic function that is fitted and generated has the higher fitting accuracy and is the more favorable for vertex calculation than other images.

In an embodiment, in the step of performing the power conversion on at least three the flicker values during conversion step B, a $2\text{-}4^{th}$ power conversion is performed.

In the present solution, the power value selects the interval of $2\text{-}4^{th}$ powers, and the image of the unary quadratic function that is fitted and generated has higher fitting accuracy, and is more favorable for the vertex calculation.

In an embodiment, after conversion step B, if the fitting effect of the unary quadratic function is not good, at least three different the common voltage values are reselected to measure the flicker value, and perform step A again.

In the present solution, such a design facilitates the implementation of the automatic detection, if the common voltage value selected in the previous time in measurement step B is not good and causes the fitting effect of the unary quadratic function in the conversion step B not to be good, the measurement of the flicker value is performed on at least three the different common voltage values again to until the unary quadratic function fitting condition is met.

In an embodiment, after conversion step B, if the fitting effect of the unary quadratic function is not good, a different power value is selected to re-perform the power conversion again, and conversion step B is performed again.

In the present solution, such a design facilitates the implementation of the automatic detection, if the selection of the power value in conversion step B is not good and causes the fitting effect of the unary quadratic function in conversion step B is not good, a different power value is selected again to re-perform the power conversion again until the unary quadratic function fitting condition is met.

Figure 7:
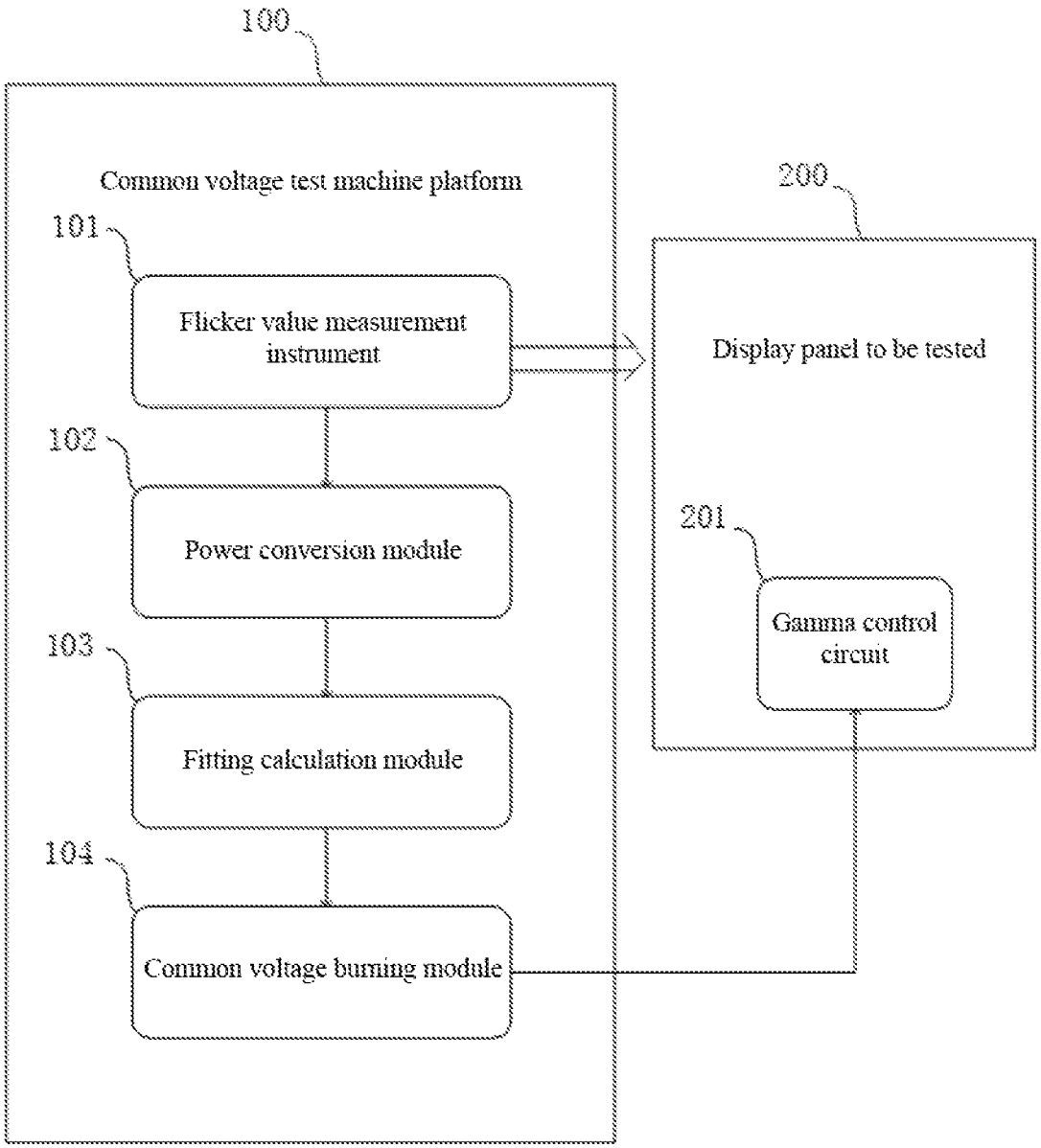
FIG. 7 is a structural diagram of a common voltage test machine platform of one of the embodiments of the present application.

As shown in FIG. 7, in another embodiment of the present application, a common voltage test machine platform 100 of a display panel is further disclosed, including:

a flicker value measurement instrument 101 for measuring a flicker value of the display panel 200 to be tested; wherein the flicker value measurement instrument 101 can be selected as a color analyzer or a high-speed luminance meter;

a power conversion component 102 connected to the flicker value measurement instrument 101 to perform power conversion on the flicker value measured by the flicker value measurement instrument 101; where the power conversion component 102 preferably performs a $2.5^{th}$ power conversion on the flicker value measured by the flicker value measurement instrument 101; and a fitting calculation component 103 for performs a unary quadratic function fitting on the flicker value generated by the power square conversion component 102 and the corresponding common voltage, and outputting a common voltage value corresponding to the vertex of the unary quadratic function as the common voltage of the display panel 200 to be tested.

In an embodiment, the common voltage test machine platform 100 of the display panel further includes a common voltage burning component 104, the common voltage burning component 104 is electrically connected to a gamma control circuit 201 of the display panel 200 to be tested to burn the common voltage value output by the fitting calculation component into the gamma control circuit of the display panel to be tested. This design directly burns the optimal common voltage into the gamma control circuit, if one burning is directly completed, the degree of automation is better.

As the common voltage test machine platform 100 of the display panel according to the embodiment of the present application sets the flicker value measurement instrument 101, the power conversion component 102 and the fitting calculation component 103, performs the power conversion on the measured flicker value, performs the unary quadratic function fitting on the converted flicker value and the corresponding common voltage, and uses the characteristics of the unary quadratic function to quickly find the common voltage value corresponding to the vertex of the unary quadratic function, which is the optimal common voltage value of the display panel, this simplifies a workflow and shortens the time to find the optimal common voltage value.

Figure 8:
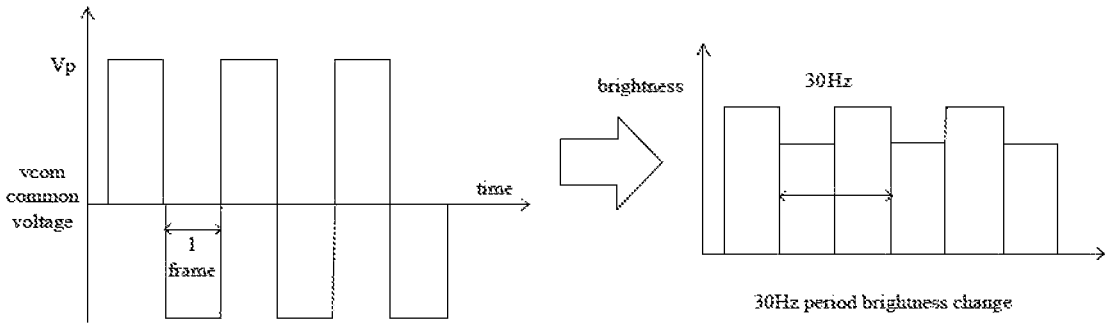
FIG. 8 is a diagram of changes in luminance of a display panel before a common voltage Vcom is adjusted.
Figure 9:
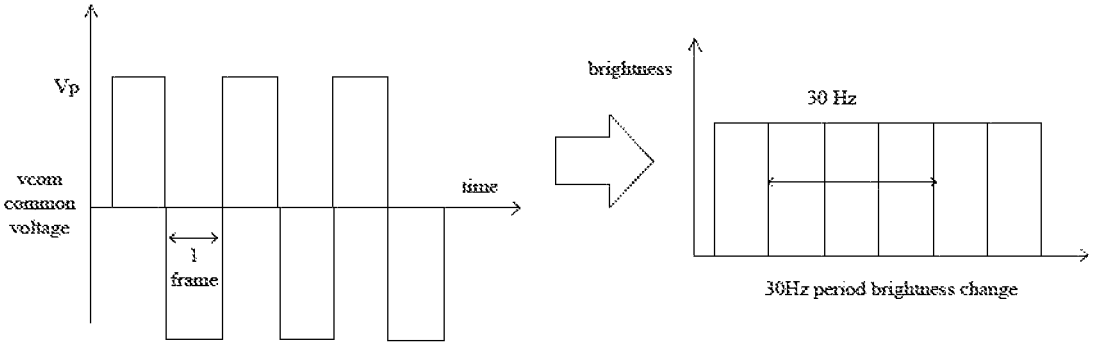
FIG. 9 is a diagram of changes in luminance of a display panel after the common voltage Vcom is adjusted.

The flicker effect before and after the adjustment of the optimal common voltage Vcom is verified:

As shown in FIG. 8, before the Vcom is adjusted, the difference between the pixel voltages of positive and negative polarities and the voltage Vcom of the display panel is inconsistent, and the display period thereof is 30 Hz, the brightness of the display panel is different during the display period, the brightness changes obviously, and the flicker value is obvious; after the common voltage value corresponding to the vertex of the unary quadratic function is found as the optimal common voltage value and written into the gamma control circuit 201 of the display panel 200 to be tested, as shown in FIG. 9, the difference between the pixel voltages of positive and negative polarities and the voltage Vcom of the display panel is almost the same and the display period thereof is 30 Hz, there is no significant difference in the brightness of the display panel during the display period, and the flicker is obviously improved.

The panel of the present application may be a TN panel (full name Twisted Nematic, ie, a twisted nematic panel), an IPS panel (In-Plane Switching), a VA panel (Multi-domain Vertica Alignment), of course, other types of the panels can also be used.

The above is a detailed description of the present application in conjunction with the specific optional embodiments, and the specific implementation of the present application is not limited to the description. It will be apparent to those skilled in the art that a plurality of deductions or replacements can also be made without departing from the inventive concept and may fall into the scope of protection of the present invention.

What is claimed is:

1. A method of quickly searching for a common voltage of a display panel, comprising the following steps of:

measuring a flicker value of the display panel at any at least three different common voltage values;

performing a power conversion on at least three the flicker values above, and performing a unary quadratic function fitting on the converted flicker value and the corresponding common voltage; and obtaining the common voltage value corresponding to the vertex of the unary quadratic function as a common voltage of the display panel.

2. The method for quickly searching for the common voltage of the display panel according to claim 1, wherein in the step of performing the power conversion at least three the flicker values, a $2.5^{th}$ power conversion is performed.

3. The method for quickly searching for the common voltage of the display panel according to claim 1, wherein in the step of performing the power conversion at least three the flicker values, a $2\text{-}4^{th}$ power conversion is performed.

4. The method for quickly searching for the common voltage of the display panel according to claim 1, wherein in the step of performing the power conversion at least three the flicker values, a $3^{rd}$ power conversion is performed.

5. The method for quickly searching for the common voltage of the display panel according to claim 1, wherein after the step of performing the power conversion on at least three the flicker values and performing the unary quadratic function fitting on the converted flicker value and the corresponding common voltage, if the fitting effect of the unary quadratic function is not good, the step of measuring the flicker value of the display panel at any three different common voltage values is performed again, and at least three different the common voltage values are reselected to measure the flicker value.

6. The method for quickly searching for the common voltage of the display panel according to claim 1, wherein after the step of performing the power conversion on at least three the flicker values and performing the unary quadratic function fitting on the converted flicker value values and the corresponding common voltage, if the fitting effect of the unary quadratic function is not good, the step of performing the power conversion on at least three the flicker values is performed again, and a different power value is selected to re-perform the power conversion again.

7. The method for quickly searching for the common voltage of the display panel according to claim 1, wherein in the step of measuring the flicker value of the display panel at any at least three different common voltage values, only the flicker values at three different common voltage values are performed.

8. The method for quickly searching for the common voltage of the display panel according to claim 1, wherein in the step of measuring the flicker values of the display panel at any at least three different common voltage values, the flicker value at the four or five different common voltage values are measured.

9. The method for quickly searching for the common voltage of the display panel according to claim 1, wherein in the step of obtaining the common voltage value corresponding to the vertex of a unary quadratic function as the common voltage of the display panel includes the step of burning the obtained common voltage value into a gamma control circuit of the display panel.

10. The method for quickly searching for the common voltage of the display panel according to claim 1, wherein the method of quickly searching for the common voltage of the display panel further comprises the step of verifying an adjusted flicker effect by using the obtained common voltage value.

11. A method for quickly searching for a common voltage of a display panel, comprising the following steps of:

measuring a flicker value of the display panel at any at least three different common voltage values;

performing a $2.5^{th}$ power conversion on at least three the flicker values, and performing a unary quadratic function fitting on the converted flicker value and the corresponding common voltage; and obtaining the common voltage value corresponding to the vertex of a unary quadratic function as the common voltage of the display panel.

12. A common voltage test machine platform of a display panel, comprising:

a flicker value measurement instrument for measuring a flicker value of the display panel to be tested;

a power conversion component connected to a signal of the flicker value measurement instrument and performing for a power conversion on at least three the flicker values measured by the flicker value measurement instrument; and a fitting calculation component for performing a unary quadratic function fitting on the flicker value generated by the power conversion component and the corresponding common voltage and outputting the common voltage value corresponding to the vertex of the unary quadratic function as the common voltage of the display panel to be tested.

13. The common voltage test machine platform of the display panel according to claim 12, wherein the power conversion component performs a $2.5^{th}$ power conversion on the flicker value measured by the flicker value measurement instrument.

14. The common voltage test machine platform of the display panel according to claim 12, wherein the power conversion component performs a $3^{rd}$ power conversion on the flicker value measured by the flicker value measurement instrument.

15. The common voltage test machine platform of the display panel according to claim 12, wherein the common voltage test machine of the display panel further comprises a common voltage burning component, the common voltage burning component is electrically connected to a gamma control circuit of the display panel to be tested to burn the common voltage value output by the fitting calculation component into the gamma control circuit of the display panel to be tested.

16. The common voltage test machine platform of the display panel according to claim 12, wherein the flicker measurement instrument is a color analyzer.

17. The common voltage test machine platform of the display panel according to claim 12, wherein the flicker measurement instrument is a high speed luminance meter.

18. The common voltage test machine platform of the display panel according to claim 12, wherein the display panel is a liquid crystal display panel.

* * * * *